US007392887B2

(12) United States Patent
Heyden et al.

(10) Patent No.: US 7,392,887 B2
(45) Date of Patent: Jul. 1, 2008

(54) BLADDER ACTUATOR FOR A RAILROAD RETARDER

(75) Inventors: Thomas J. Heyden, Arlington Heights, IL (US); Richard Bohme, Louisville, WI (US); Mark Zawlocki, Menomonee Falls, WI (US)

(73) Assignee: AAA Sales + Engineering, Inc., Oak Creek, WI (US)

( * ) Notice: Subject to any disclaimer, the term of this patent is extended or adjusted under 35 U.S.C. 154(b) by 455 days.

(21) Appl. No.: 11/103,936

(22) Filed: Apr. 12, 2005

(65) Prior Publication Data

US 2006/0225968 A1 Oct. 12, 2006

(51) Int. Cl.
*F16D 65/24* (2006.01)

(52) U.S. Cl. ..... 188/170; 188/43; 267/64.11

(58) Field of Classification Search ..... 188/170, 188/56, 35, 41, 43, 62; 267/64.11, 64.15; 92/93, 63, 43, 44, 45

See application file for complete search history.

(56) References Cited

U.S. PATENT DOCUMENTS

| | | | | |
|---|---|---|---|---|
| 1,169,250 A | | 1/1916 | Fulton | |
| 1,928,368 A | | 9/1933 | Coffey | |
| 2,326,924 A | | 8/1943 | Bone | |
| 2,963,043 A | | 12/1960 | Davis et al. | |
| 3,042,771 A | | 7/1962 | Oliveau | |
| 3,187,642 A | * | 6/1965 | Cruse | 92/128 |
| 3,196,985 A | | 7/1965 | Rowe et al. | |
| 3,255,676 A | * | 6/1966 | Berg et al. | 92/29 |
| 3,557,665 A | * | 1/1971 | Von Lowis | 92/13 |
| 3,659,680 A | | 5/1972 | Soulakis et al. | 188/62 |
| 3,695,648 A | * | 10/1972 | Marosy | 285/376 |
| 3,935,795 A | | 2/1976 | Hawley | 92/5 |
| 3,946,973 A | | 3/1976 | Budway et al. | 246/182 |
| 4,030,574 A | | 6/1977 | Evans | 188/62 |
| 4,125,177 A | | 11/1978 | Durraffourt | 188/62 |
| 4,198,909 A | | 4/1980 | Plantureux | 104/26 |
| 4,292,885 A | | 10/1981 | Jinnouchi | 92/43 |
| 4,400,238 A | | 8/1983 | Stanislaw et al. | 162/273 |
| 4,513,843 A | | 4/1985 | Danieli et al. | 188/62 |

(Continued)

OTHER PUBLICATIONS

"Smith's Vacuum-Brake" Continuous Railway Brakes, by Michael Reynolds, 1882.

(Continued)

*Primary Examiner*—Xuan Lan Nguyen
(74) *Attorney, Agent, or Firm*—Andrus, Sceales, Starke & Sawall, LLP

(57) ABSTRACT

The present invention pertains to a low-maintenance bladder actuator for a low-profile railroad retarder. The actuator has an internal guide mechanism and internal limit stops. The guide mechanism has a concentric, telescoping guide rod and guide sleeve that are removably bolted to upper and lower plates. An integral cast head forms the upper plate and a stop sleeve that absorbs the cyclical 20,000 pound loads of the actuator. This enables the guide rod to remain concentricly aligned. The guide mechanism has sufficient stroke length ($S_L$) and includes a long internal bushing with a low wear rate. The stop sleeve engages the lower plate to form the lower limit stop. The stop sleeve includes an inwardly extending flange that engages an outwardly extending flange of the guide sleeve to form an upper limit stop. The stop sleeve and guide sleeve form a cam lock connection for easy assembly.

6 Claims, 8 Drawing Sheets

U.S. PATENT DOCUMENTS

| | | | | | |
|---|---|---|---|---|---|
| 4,535,872 | A | | 8/1985 | Bick et al. | 188/62 |
| 4,650,038 | A | | 3/1987 | Bick | 188/62 |
| 4,867,279 | A | | 9/1989 | Link et al. | 188/62 |
| RE33,207 | E | | 5/1990 | Brodeur | 188/1.11 |
| 5,092,248 | A | | 3/1992 | Parry | 104/26.2 |
| 5,333,707 | A | | 8/1994 | Kaneda | 188/296 |
| 5,388,525 | A | | 2/1995 | Bodkin | 104/26.2 |
| 5,575,218 | A | | 11/1996 | Gutknecht | 104/249 |
| 5,676,337 | A | | 10/1997 | Giras et al. | 246/182 |
| 5,816,371 | A | * | 10/1998 | Buckley et al. | 188/170 |
| RE36,084 | E | | 2/1999 | Gutknecht | 104/249 |
| 6,220,400 | B1 | | 4/2001 | Kickbush | 188/62 |
| 6,530,682 | B2 | * | 3/2003 | Wu | 362/413 |
| 2004/0182659 | A1 | * | 9/2004 | Siebke | 188/167 |

OTHER PUBLICATIONS

Firestone Engineering Manual & Design Guide, Airstroke Actuator, 1998.

Goodyear Vehicular Applications Engineering Manual, Super Cushion Air Springs, (date unknown, admitted prior art).

Goodyear Industrial Applications Design Guide, Super Cushion Air Springs, (date unknown, admitted prior art).

* cited by examiner

BLADDER ACTUATOR FOR A RAILROAD RETARDER

BACKGROUND OF THE INVENTION

Bladders or bellows are well known commercial devices for controlling the relative movement between two parts. These devices typically include a guide and upper and lower limit stops. U.S. Pat. No. 1,169,250 to Fulton discloses a shock absorber for water pipes. The device has a collapsible and expandable vessel located between and secured to centrally perforated inflexible end walls. The apparatus includes a guide for limiting relative lateral motion of the plates. U.S. Pat. No. 1,928,368 to Coffey pertains to vehicle jack with three telescoping cylindrical sections. A collapsible and extendable rubber sack or lining is used inside the telescoping sections. Shoulders and flanges limit outward telescoping movement. U.S. Pat. No. 3,935,795 to Hawley discloses a bellows actuator with opposed ends that are closed by circular disks. The disks are mounted to hubs that are rigidly secured to a shaft. The hubs limit the minimum and maximum length of extension. U.S. Pat. No. 4,292,885 to Jinnouchi pertains to an apparatus having a bellows with a main body and a restriction means. The restriction means restricts elongation and contraction via guide metals, guide members and stoppers. Jinnouchi recognizes the limited stroke length ($S_L$) associated with telescoping sleeves.

Bladder actuators are well known in the railroad industry. In 1882, the Smith Vacuum Brake included a sack or collapsing cylinder. The sack has upper and lower plates and a flexible bladder joined to the generally round perimeter of the plates to form an air-tight seal. The sack includes an internal guide mechanism formed by a guide sleeve and guide rod positioned along a centerline of the sack. The pinned connections allow the guide sleeve and rod to guide the motion of the sack. The sleeve is pinned to the frame of the railroad car, passes through the upper plate and extends into the sack a given distance. The guide rod is coupled to the lower plate, pinned to a braking assembly and is slidingly received in the larger diameter sleeve. When vacuum is supplied to the sack, the lower plate and guide rod are drawn up, which moves the brake assembly to a braking position. The engagement of the brake pads against the wheels of the train forms an upper stop for the sack. When vacuum is relieved, the lower plate and guide rod of the sacks are biased to drop down under the weight of the brake assembly, which moves the brake assembly to a non-braking position.

The Firestone AIRSTROKE actuator developed in the 1930s includes upper and lower plates and a flexible bladder secured around the perimeter of each plate to form an airtight interior. The actuator is inflated and deflated to control its height. Down and up stops are used to set the minimum and maximum height or stroke length ($S_L$) of the actuator. A bumper, a chain, a cable or metal stops can be located inside the actuator for this purpose. Firestone recommends guiding the stroke of the actuator. The actuator is recommended for use in a wide variety of applications including braking applications, such as a Roller Friction Brake with an external guide rod and guide sleeve with upper and lower stops. Firestone acknowledges that companies such as Selson and Minster have modified the actuator to locate all the guide and limit stops inside the actuator. The AIRSTROKE actuator has been used in railroad braking systems. U.S. Reissue Pat. No. Re 33,207 to Brodeur discloses an on-board braking system using the Firestone actuator. U.S. Pat. No. 6,220,400 to Kickbush discloses a low profile, railway car retarder using the Firestone actuator. The actuator has an internal guide formed by two telescoping tubes, one of which has a stop ring at its end to form the upper and lower limit stops.

The railroad marshalling yard environment is dirty, rugged and non-stop. Retarders, switches, actuators, compressed air controls and other components along tracks must withstand exposure to harsh weather, dirt, gravel, petroleum and other chemicals, and withstand being struck by moving objects carried by the cars. Moreover, actuators for retarders produce static vertical forces of about 20,000 pounds to generate the necessary braking power to control the speed of a fully loaded railroad car. Given this demanding environment, the railroad industry places great significance on minimizing maintenance and down time. Bladder actuators must withstand large cyclical loads and a harsh environment while maintaining low maintenance and down time requirements similar to conventional rigid cylinder actuators. For safety reasons, the guide mechanism and limit stops of the bladder actuator are preferably located inside the actuator to minimize the chance of a worker inadvertently getting his or her fingers caught between the moving parts when the actuator is rapidly opened or closed. Given that bladder actuators are typically round, the obvious location of an internal guide and limit stops is toward the center of the actuator.

A problem with an internal guiding mechanism for a bladder actuator is the rapid wear of the internal friction bearing. The actuator produces about 20,000 pounds of upward force to move the plates apart. The friction bearings also experience lateral loads of over 1,000 pounds to maintain the upper and lower plates in parallel alignment and concentric registry. The concentric, telescoping guide rod and guide sleeve include a friction bearing or bushing to allow sliding engagement as the actuator opens or closes. Accelerated wear of the bushing occurs when the lateral loads push guide rod out of concentric alignment. Deflection of the guide rod causes an exponential increase in the lateral load, which increases the frictional forces and wear on the bushing. The worn bushing allows further misalignment of the guide rod, increased lateral loads, and even more rapid wear of the busing. This is a particularly significant problem with actuators for low profile retarders because a short bushing length is not able to distribute the lateral load over a large busing surface area. The ends of the bushing tend to wear quickly. Yet, frequent maintenance to replace the bushing is time consuming and expensive and results in costly down-time for the yard.

Another problem occurs when an internal guide rod forms the upper and lower stops of the actuator as in U.S. Pat. No. 6,220,400. The guide rod experiences a tension load in excess of 20,000 pounds each time the actuator is opened. This cyclical load loosens the threaded engagement of the guide rod to the upper plate. Yet, as noted above, maintaining the alignment of the guide rod is critical. Even a slight loosening of the guide rod can result in some lateral movement, which will exponentially increase the loads on and wear rate of the internal bushing or bearing. This loosening of the guide rod, or even the potential loosening of the guide rod, significantly increases the need for routine maintenance and possible down time.

A further problem with an internal guide mechanism for bladder actuator for a low-profile railroad retarder is the trade off between stroke length ($S_L$) and bushing length. A certain amount of stroke length ($S_L$) is necessary given the geometry of the retarder and its levers. The actuator must ensure that the brake pads come together close enough to ensure that proper braking force is applied to the wheels of various railroad cars. The actuator must also ensure that the brake pads retract sufficiently far from the railroad car wheels when in a non-braking position. Inadvertent contact with the wheels can result in derailments and loss of life. Yet, as indicated in Jinnouchi, when a guide mechanism is fixed entirely between the upper and lower plates and uses a stop ring at the end of the guide rod, the maximum stroke length ($S_L$) is ½ the distance between the plates when the actuator is in its full open position. The stroke length is further reduced by the length of the bushing engaging the guide rod. Thus, an actuator for a low profile retarder as in FIG. 3 of U.S. Pat. No. 6,220,400, the length of the bushing is kept to a minimum in order to reduce the height of the actuator and obtain necessary stroke length ($S_L$). Yet, a short bushing will have difficulty maintaining concentric alignment of the guide rod and will wear quickly and require frequent maintenance.

The present invention is intended to solve these and other problems.

BRIEF DESCRIPTION OF THE INVENTION

The present invention pertains to a low-maintenance bladder actuator for a low-profile railroad retarder. The actuator has an internal guide mechanism and internal limit stops. The guide mechanism has a concentric, telescoping guide rod and guide sleeve that are removably bolted to upper and lower plates. An integral cast head forms the upper plate and a stop sleeve that absorbs the cyclical 20,000 pound loads of the actuator. This enables the guide rod to remain concentricly aligned. The guide mechanism has sufficient stroke length ($S_L$) and includes a long internal bushing with a low wear rate. The stop sleeve engages the lower plate to form the lower limit stop. The stop sleeve includes an inwardly extending flange that engages an outwardly extending flange of the guide sleeve to form an upper limit stop. The stop sleeve and guide sleeve form a cam lock connection for easy assembly.

One advantage of the present actuator is its internal guide and limit stops require minimal maintenance. The stop sleeve is provided to form the upper and lower limit stops. The guide rod does not form these stops. The 20,000 pound impact loads produced by the actuator do not pass through guide rod or the four (4) bolts that secure it to the upper plate of the caste head. These bolts remain tight and maintain the guide rod in its centrally aligned position. In addition, the outside diameter (OD) of the guide rod and guide sleeve are closely matched to the inside diameter (ID) of the central opening of the upper and lower plates. The ID of the central opening of the upper and lower plates are within about three-thousandths of an inch of the OD of the shaft of the guide rod or guide sleeve, respectively. Much of the cyclical 1,000 pound lateral loads experienced by the guide rod and guide sleeve pass directly to the sidewall of the opening of the plates. The bolts remain tight and keep the guide rod and guide sleeve in their intended alignment. This increases the life of the internal friction bearings, and results in a less frequent maintenance schedule to ensure proper bolt integrity, guide rod and guide sleeve alignment and bearing life. Thus, the present invention reduces maintenance and financially costly and serious life threatening accidents that can result from equipment malfunctions, each of which is a major concern of the railroad industry.

Another advantage of the present actuator is its stop sleeve and guide sleeve design. The cast head integrally joins the stop sleeve and upper plate. No bolts are needed to secure the stop sleeve to the upper plate. The 20,000 pound impact loads experienced by the stop sleeve do not affect its alignment. The stop sleeve is longer than the guide sleeve, so it forms the lower stop by engaging the lower plate. The concentric alignment of the guide sleeve is maintained by the relatively large diameter of its middle securement flange, which allows eight (8) bolts to secure it to the lower plate. The large number of bolts and their radial distance from the centerline of the actuator minimize the affect of any slight loosening of the bolts, which keeps maintenance and down time to a minimum.

A further advantage of the present actuator is that its guide mechanism and limit stops accommodate stroke length ($S_L$) and friction bearing length. The actuator has a stroke length of about 3⅜ inches. The guide sleeve bushing has a length of about 3½ inches. The ID of the bushing is within about five thousandths of an inch of the OD of the shaft of the guide rod. Significant attention is given to the length of the bushing and the tight tolerances between the ID of the bushing and OD of the guide rod to achieve a tight sliding fit between them. The relatively long bushing spreads the 1,000 pound lateral load over a long length and large surface area to reduce the frictional forces and reduce the rate of wear of the bushing surface that engages the guide rod, particularly at the ends of the bushing. The length of the bushing also helps maintain the guide rod in its intended central alignment. The longer the bushing, the smaller the permissible shift in guide rod alignment due to the well known principle of rise (tolerance) over run (bushing length).

A still further advantage of the present actuator is the cam lock connection between the guide sleeve and stop sleeve. The cam lock connection facilitates assembly and eliminates the need for some welds during assembly.

Other aspects and advantages of the invention will become apparent upon making reference to the specification, claims and drawings.

DESCRIPTION OF THE PREFERRED EMBODIMENTS

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

Figure 1:
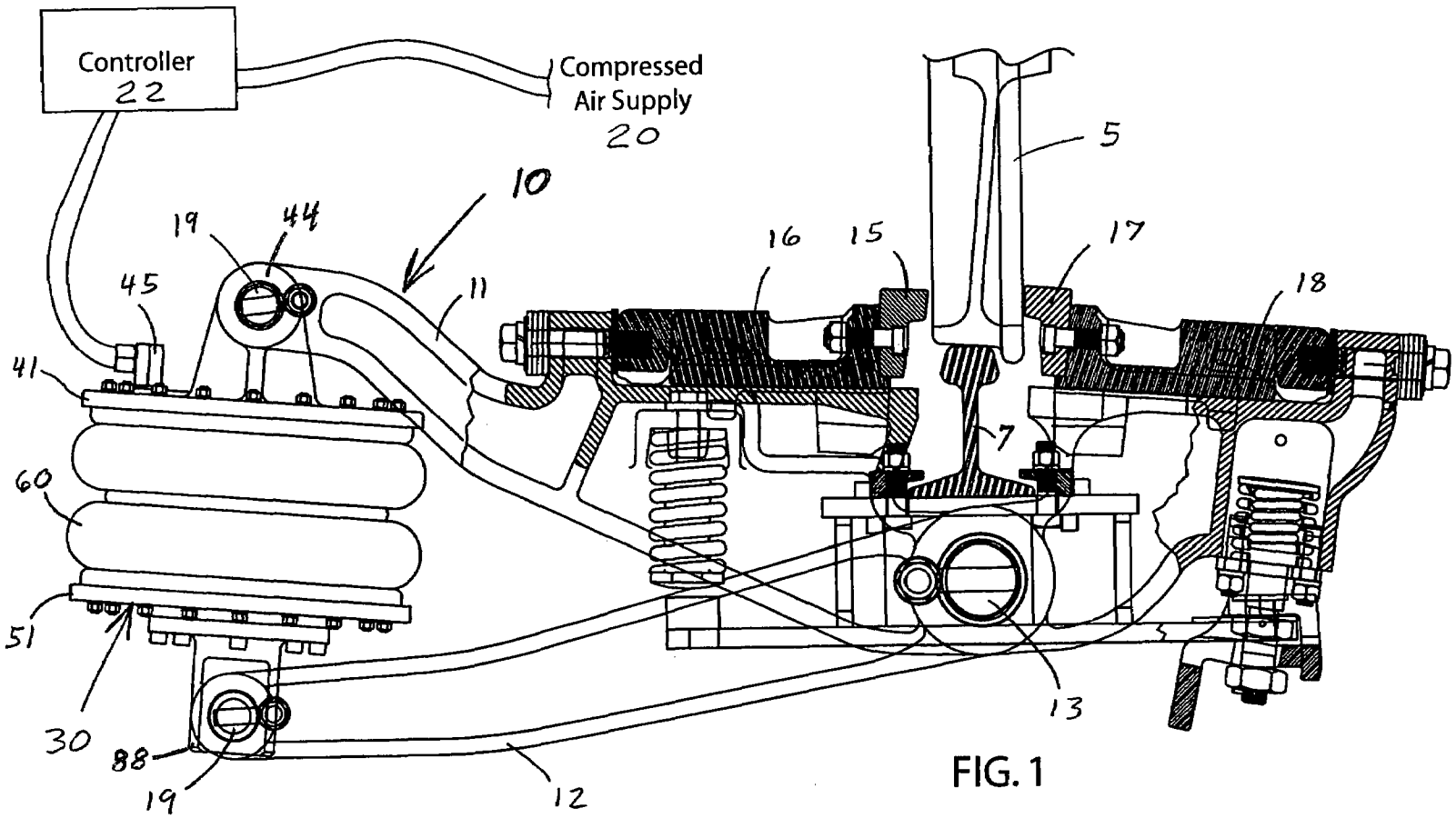
FIG. 1 is a side plan view of the present bladder actuator installed on a low-profile railroad retarder with upper and lower levers with brake pads for engaging the wheel of a railroad car.

FIG. 1 shows a wheel 5 of a railroad car riding on one rail 7 of a track. The wheel 5 is passing by a low profile retarder 10 having upper and lower levers 11 and 12 pivotally joined by a pin 13 that acts as a fulcrum. The upper lever 11 has a brake pad 15 and lateral positioning mechanism 16 on the field side of the rail 7. The lower lever 12 has a brake pad 17 and lateral positioning mechanism 18 on the gauge side of the rail 7. The fulcrum pin 13 is located directly under the rail 7. The free end of each lever 11 and 12 has a circular opening for receiving a tubular pivot pin 19. Each pivot pin 19 is held in place by a lock key. The retarder 10 controls the speed of the railroad cars in a marshalling yard. The marshalling yard includes a compressed air supply 20 that is maintained above 120 psig, and a conventional controller 22 that controllably supplies compressed air to the retarder 10.

Figure 2:
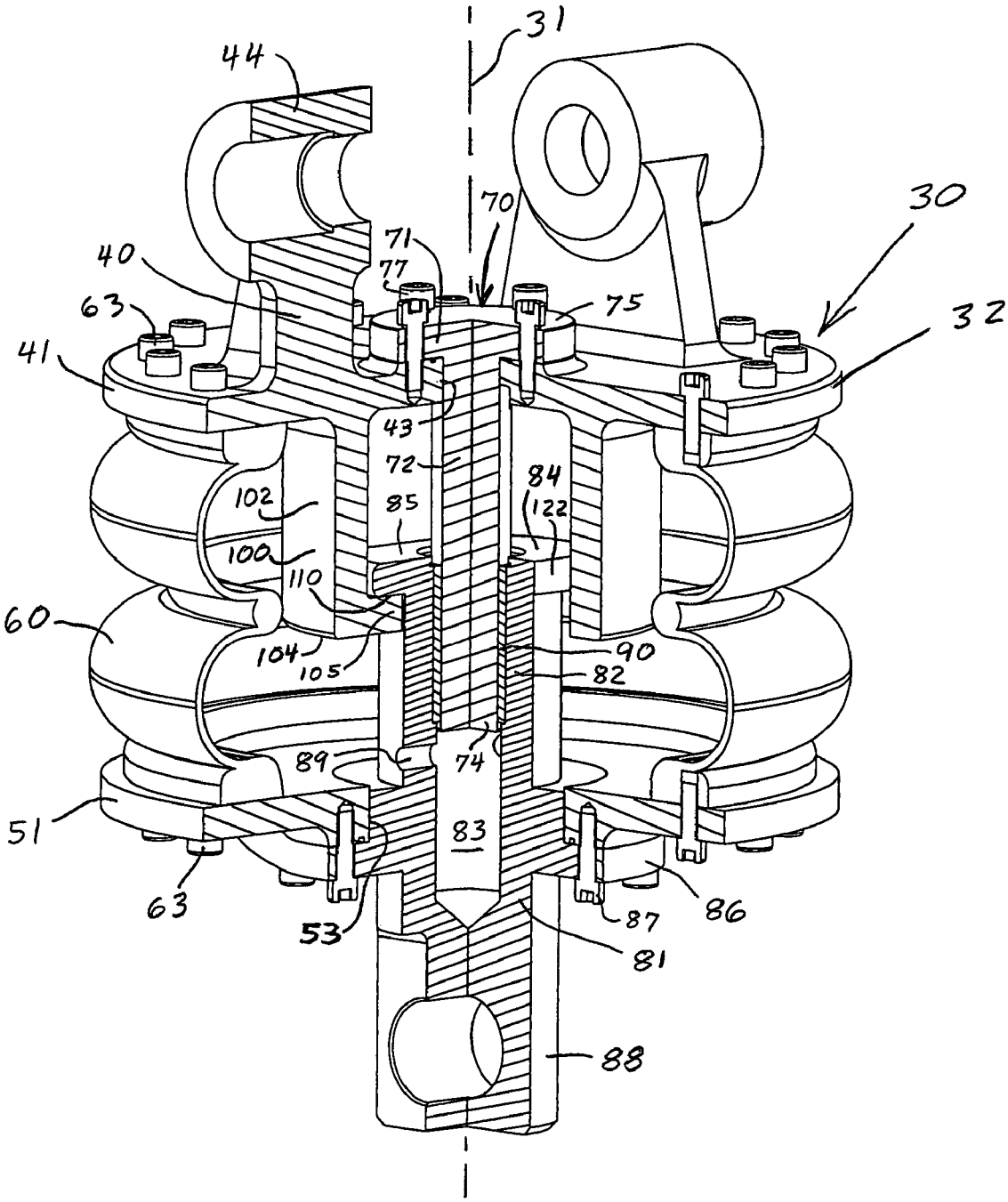
FIG. 2 is a perspective, partial cut away view of the bladder actuator of the present invention showing the preferred structure of the guide mechanism and stop sleeve.
Figure 3:
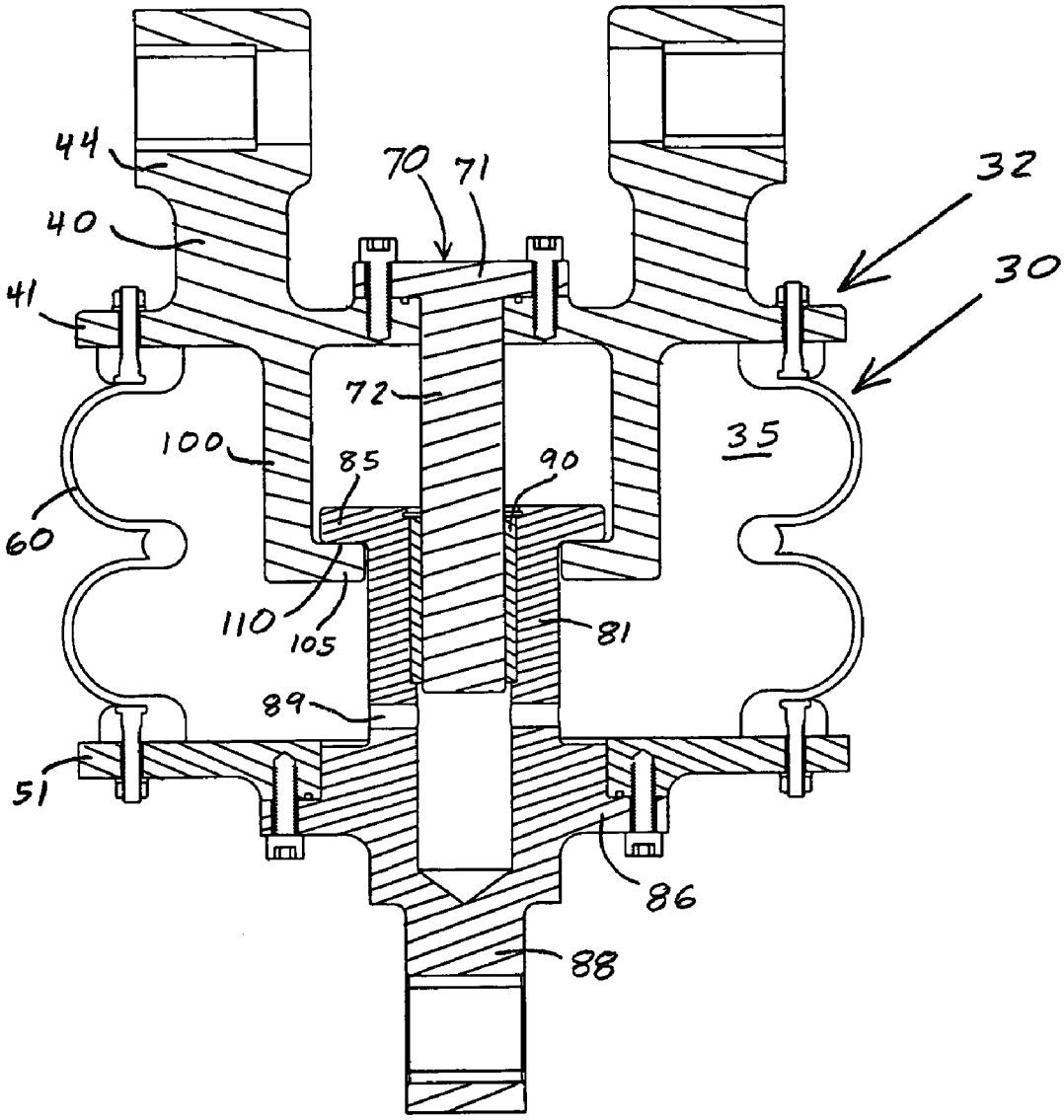
FIG. 3 is a side sectional view of the bladder actuator in its fully extended position with the stop flange of the stop sleeve engaging the stop flange of the guide
Figure 4:
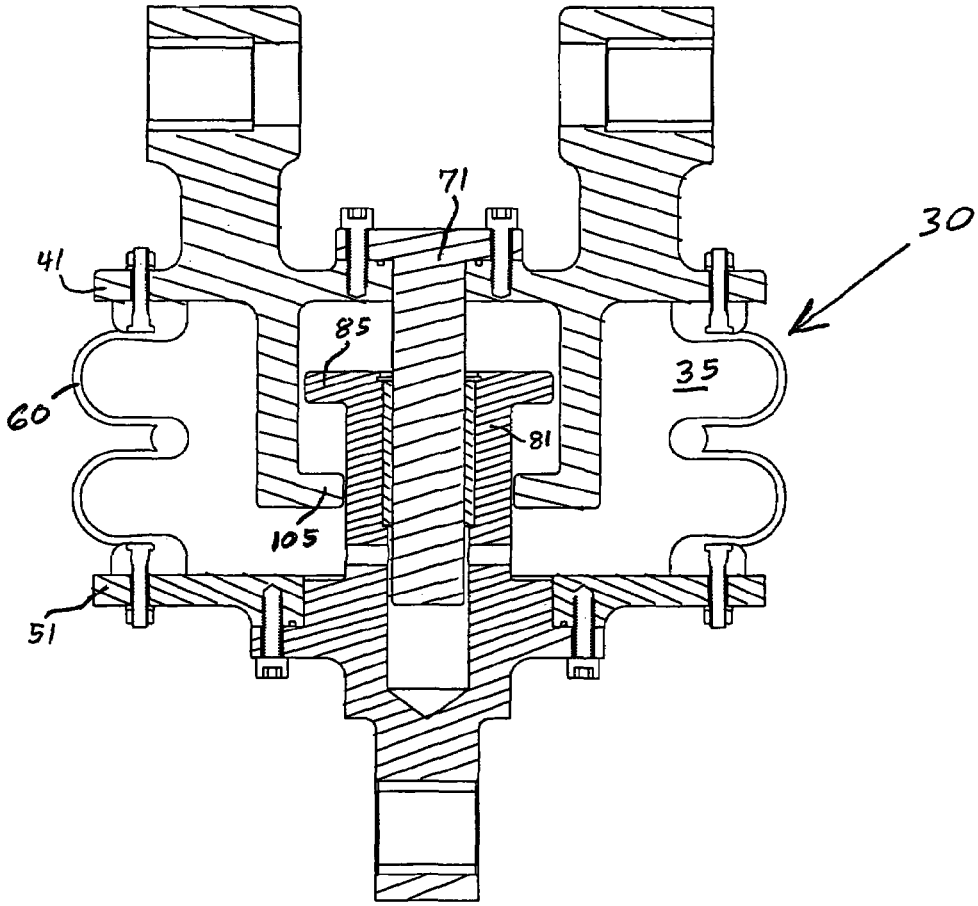
FIG. 4 is a side sectional view of the bladder actuator in an intermediate position.
Figure 5:
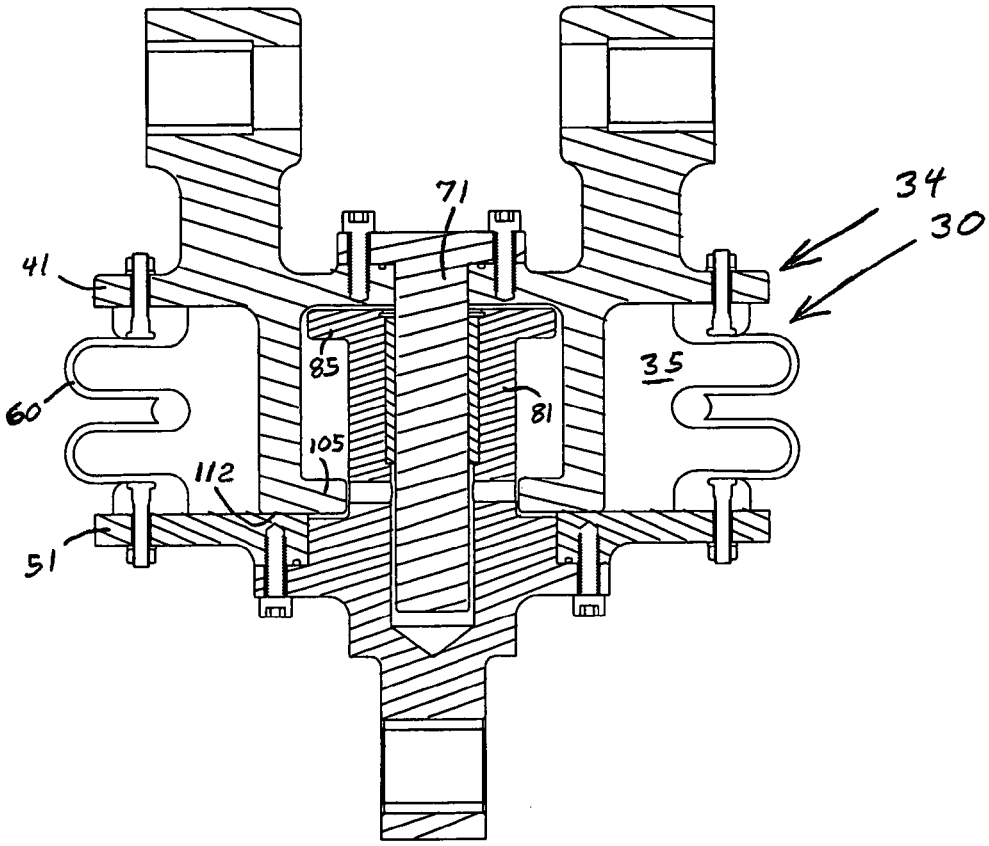
FIG. 5 is a side sectional view of the bladder actuator in its fully contracted position with the stop flange of the stop sleeve engaging the upper plate.

The present invention relates to a bellow actuator generally designated by reference number 30 and shown in FIGS. 1 and 2. The actuator 30 has a generally round perimeter when viewed from above that defines a centerline 31 for the actuator. The actuator 30 moves between extended 32 and contracted 34 positions to open and close the retarder 10 as shown in FIGS. 3-5. The actuator 30 is connected to the 120 psig to 150 psig compressed air system 20 for the yard in a manner similar to conventional pneumatic actuators with a rigid cylinder. The controller 22 has control valves (not shown) to selectively supply compressed air to and release air from the actuator 30. When an intake valve is opened, compressed air is supplied to a sealed interior 35 of the actuator 30, which causes it to move to its expanded position 32 (FIGS. 2 and 3), and supply braking power via the retarder 10 to the wheels 5 of the cars. When the air intake valve is closed and an exhaust valve is opened, the actuator 30 is biased to its non-braking, contracted position 34 (FIG. 5), which causes the brake pads to disengage the wheels 5 of the cars. The upper lever 12 of the retarder 10 is biased by its own weight to help return the actuator 30 to its contracted position 34. The lower lever 14 is biased by a spring to help return the actuator 30 to its contracted position 34.

The actuator 30 is a modified Firestone AIRSTROKE actuator. An integrally cast steel head 40 forms an upper plate 41 that replaces the thinner upper plate provided with the Firestone actuator. Plate 41 forms a donut shaped disk with a central opening defined by a circular sidewall 43. The plate 41 and its central opening are concentric with the centerline 31 of the actuator 30. The cast steel head 40 includes a pair of spaced, outwardly projecting mounts 44. Each mount 44 has a circular cavity to pivotally receive and secure the upper end of the actuator 30 to the pivot pin 19 of the upper lever 11. The upper plate 41 includes an opening 45 for controllably receiving compressed air from the compressed air supply 20 into the interior 35 of the actuator 30, and for exhausting air from the interior of the chamber to the atmosphere.

A rolled steel plate 51 replaces the thinner lower plate of the Firestone actuator. Plate 51 forms a donut shaped disk with a central opening defined by a circular inner sidewall 53. The plate 51 and its central opening are concentric with the centerline 31 of the actuator 30. Upper and lower plates 41 and 51 remain in their intended spaced, parallel, registry in accordance with the Firestone design. The central openings of the plates 41 and 51 are coaxially aligned. Each plate 41 and 51 is robustly designed to prevent permanent deformation during many years of cyclical loading. The upper and lower ends of the bladder 60 are removably secured in an air-tight manner by bolts 63 located around the perimeter of the plates 41 and 51 via conventional bolt flanges (not shown).

The plates 41 and 51 and bladder 60 define the expandable and contractible interior 35. The actuator 5 produces a static vertical force of about 20,000 pounds when filled with air compressed to 150 psig, and generates lateral loads of over 1,000 pounds that tend to shift the upper and plates 41 and 51 out of registry.

Figure 7:
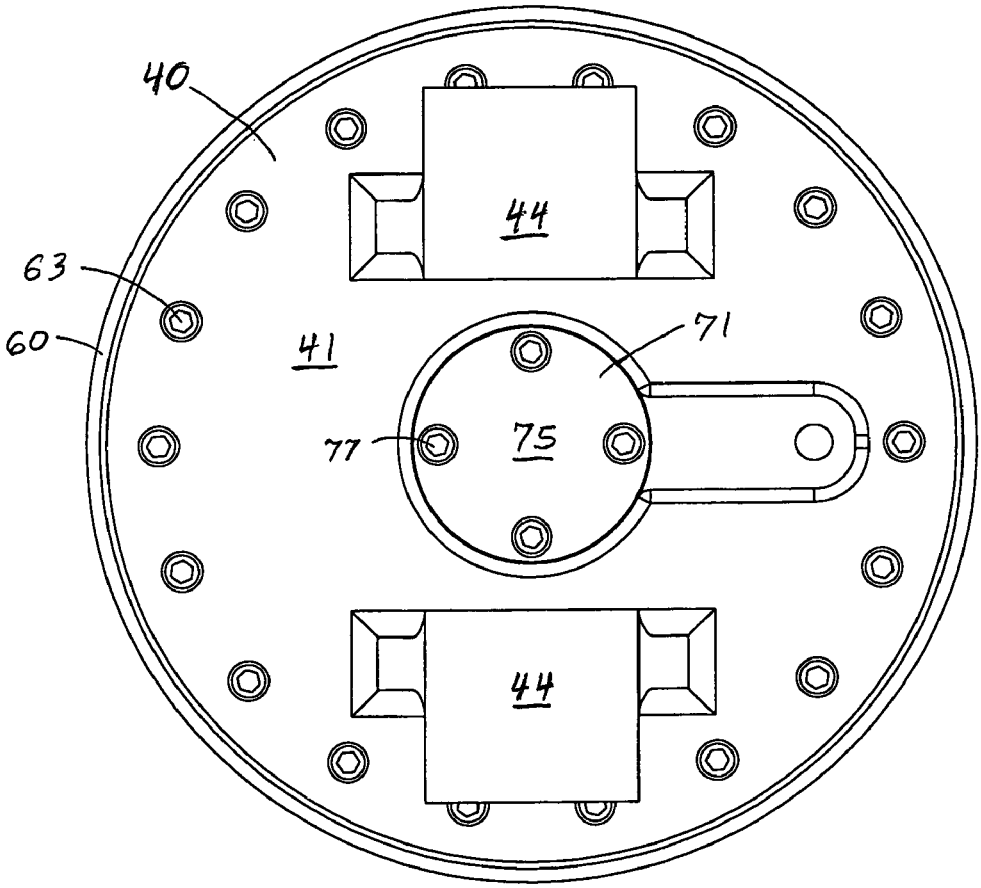
FIG. 7 is a top view of the bladder actuator.

In accordance with Firestone design, a guide is provided to keep the plates 41 and 51 in parallel registry and avoid damaging the bladder 60 due lateral shifting. The present invention provides an internal guide mechanism 70 with a guide rod 71 that extends through the central opening in the upper plate 41. The rod 71 has an axially extending shaft 72 that is coaxially aligned with the centerline 31 of the actuator 30. The rod 71 has a free end 74 and an opposed end flange 75. The end flange 75 is rigidly bolted 77 to the exterior of the plate 41. The end flange 75 has a diameter of about 4½ inches. The four bolts 77 that secure it to the upper plate 41 are about 1¾ inches from the center 31 as best shown in FIG. 7. The shaft 72 passes through the opening in the plate 41 and extends down into the interior 35 of the actuator 30.

Significant effort is made to match the outside diameter (OD) of the shaft 72 of the guide rod 71 with the inside diameter (ID) of the opening of the upper plate 41 to achieve a tight slidable fit. The outer wall of the shaft 72 abuttingly engages the circular sidewall 43 forming the opening in the plate 41. Lateral loads acting on the rod 71 are transmitted to the sidewall 43 of the plate 41 so that these loads are not transmitted to the bolts 77. This tight fit serves two purposes. First, the tight fit helps resist lateral deflection of the guide rod 71 so that shaft 72 remains centered on centerline 31. Second, the tight fit minimizes any loosening effect the lateral loads have on the bolts 77 securing the rod 71 to the plate 41. This increases the time between necessary maintenance checks to ensure proper operation of the actuator 30.

Figure 8:
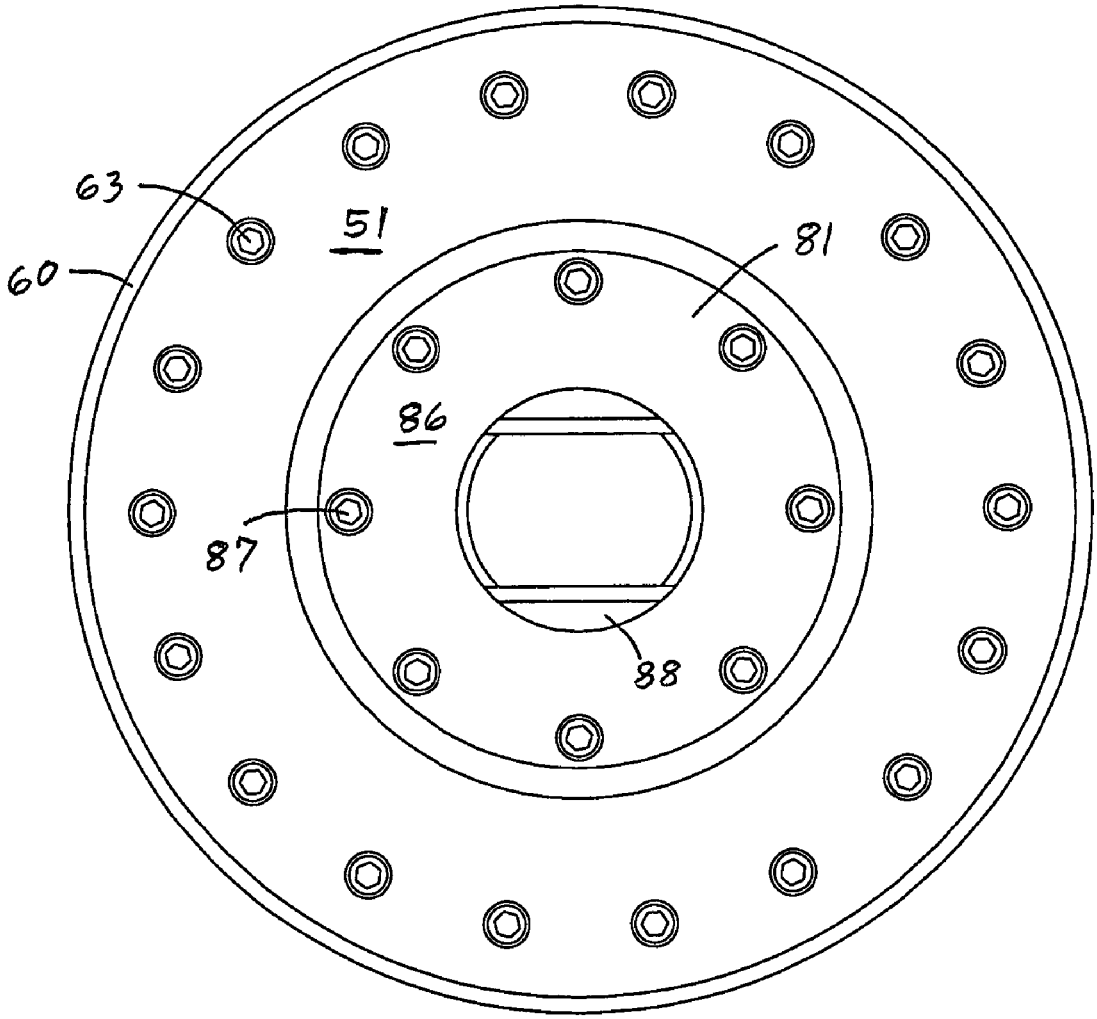
FIG. 8 is a bottom view of the bladder actuator.

The guide mechanism 70 includes a guide sleeve 81 that extends through the central opening of the lower plate 51. The sleeve 81 has a tubularly extending wall 82 that defines a bore 83. The wall 82 and bore 83 are coaxially aligned with the centerline 31 of the actuator 30. The sleeve 81 has a free end 84 with a stop flange 85, and a middle disk-shaped securement flange 86 that is rigidly bolted 87 to the exterior of the lower plate 51. The middle flange has a diameter of about 8½ inches. The eight bolts 87 that secure it to the lower plate 51 are about 3¾ inches from the center 31 as best shown in FIG. 8. The sleeve 81 passes through the opening in the plate 51 and extends up into the interior 35 of the actuator 30 a predetermined distance to form its free end 84. Free end 84 has a radially outward extending stop flange 85. The guide sleeve 81 includes an outwardly projecting mount 88. The mount 88 has a circular cavity to pivotally receive and secure the lower end of the actuator 30 to the pivot pin 19 of the lower lever 12. An air vent 89 allows air to flow into and out of the bore 83 as the guide rod 71 moves into and out of the bore 83.

The bore 83 of the guide sleeve 81 holds a conventional self lubricating manganese bronze bushing 90 suitable for handling the large lateral loads experienced by the actuator 30. The shaft 72 of the guide rod 71 extends into the bushing 90 and bore 83 of the guide sleeve 81. The bushing 90 allows sliding contact with the guide rod 71 to provide lateral alignment along the centerline 31 during operation. The ID of the bushing 90 is slightly smaller than that of the bore 83 of the guide sleeve 81 so that the shaft 72 slidingly engages the bushing and not the sleeve.

The bushing 90 has a length of about 3½ inches and an ID that is within about five-thousandths of an inch of the OD of the shaft 72. Significant attention is given to the length of the bushing 90 and the tight tolerances that match the OD of the shaft 72 to the ID of the bushing 90 to achieve a tight sliding fit between them. The relatively long length of the bushing 90 spreads the lateral load over a wide area to reduce the frictional forces and reduce wear on the bushing. The length of the bushing 90 also helps maintain the shaft 72 in its intended alignment with centerline 31. Maintaining the guide rod 71 in alignment and reducing wear on the busing 90 are important, because a deflection of the shaft 72 from the centerline 31 causes an exponential increase in the lateral load, which in turn increases the frictional forces and wear on the bushing 90 and misalignment of the guide rod. By maintaining the guide rod 71 in alignment and reducing the frictional forces on the bushing 90, the service life of the bushing and actuator 30 are dramatically improved.

In accordance with Firestone design, upper and lower limit stops are provided to avoid damage to the bladder 60 that can be caused by over extension or over compression. The head 40 has an integral stop sleeve 100 with a tubular wall 102 that extends down from the upper plate 41 and into the interior 35 a predetermined distance to form its free end 104. The free end 104 has a radially inward extending stop flange 105. The total axial length of the stop sleeve 100 is greater than the total axial length of the guide sleeve 81. When the actuator 30 is in its extended position 32 (FIGS. 2 and 3), stop flange 105 of the stop sleeve 100 engages stop flange 85 of the guide sleeve 81 to form an upper stop 110 that prevents further extension of the bladder 60. When the actuator 30 is in its contracted position 34 (FIG. 5), the stop flange 105 engages the inside surface of the lower plate 51 to form a lower stop 112 that prevents further contraction of the bladder 60. The stop sleeve 100 provides no guiding engagement to the guide sleeve 81 or guide rod 71 during the stroke. The tubular wall 102 of the stop sleeve 100 has an ID larger than the OD of the flange 85 of the guide sleeve 81. Similarly, the ID of the flange 105 of the stop sleeve 100 is substantially greater than the OD of the tubular wall 82 of the guide sleeve 81. The stop sleeve 100 does not engage or interfere with the motion of the guide sleeve 81 when the actuator moves between its extended 32 and contracted 34 positions as in FIG. 4.

Figure 6:
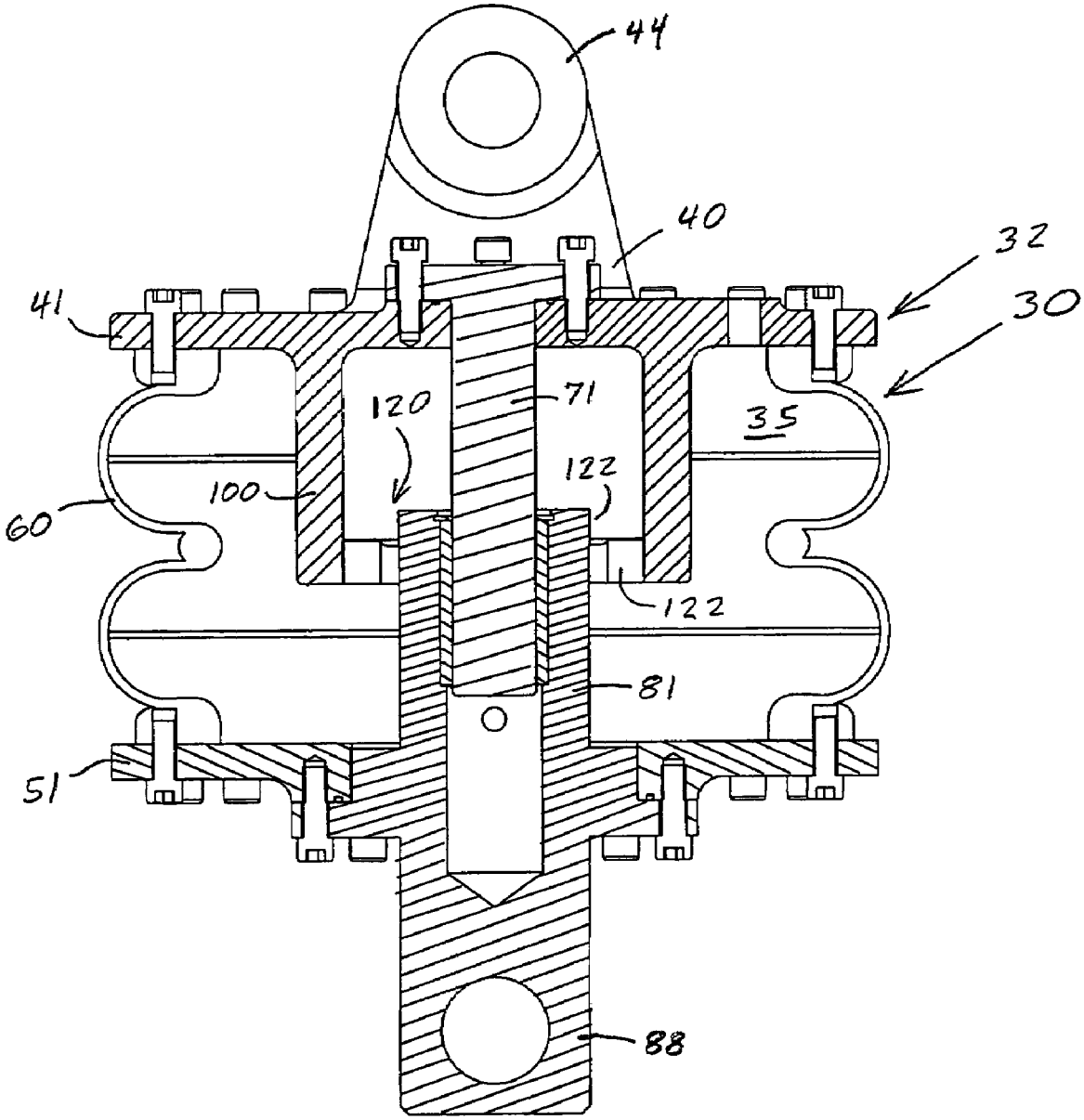
FIG. 6 is a side sectional view of the bladder actuator in its fully extended position and rotated 90 degrees to show the gaps in the stop flanges of the stop and guide sleeves.

Each radially extending stop flange 85 and 105 is formed by two opposed flange segments between two opposed gaps 122 to provide a cam lock connection 120 as best shown in FIGS. 2 and 6. The cam lock connection facilitates assembly and eliminates the need for some welds. The gaps 122 are best seen when the sleeves 81 and 100 are viewed from above. Each gap extends a little more than 90 degrees around the 360 degree circumference of the stop flange 85 and 105. During assembly, stop flanges 85 fit through the gaps in the stop flanges 105, and stop flanges 105 fit through the gaps in stop flanges 85. The guide sleeve 81 is then rotated so that the stop flanges 85 and 105 overlap and engage each other when assembled during operation. The stop sleeve 100 does not engage or guide the motion of the guide sleeve 81 or guide rod 71 when the actuator 30 moves between its extended 32 and contracted 34 positions. The wall 102 of the stop sleeve 100 has an ID larger than the OD of the stop flange 85 of the guide sleeve 81. Similarly, the stop sleeve 100 does not engage or interfere with or guide the motion of the guide sleeve 100 when the actuator moves between its extended 32 and contracted 34 positions. The ID of the stop flange 105 is substantially greater than the OD of the wall 82 of the guide sleeve 81. The guide sleeve 81 and stop sleeve 100 and their flanges 85 and 105 are robustly designed to maintain their shape and easily withstand the large, repeated impact loads associated with the expansion of the actuator 30.

While the invention has been described with reference to a preferred embodiment, it will be understood by those skilled in the art that various changes may be made and equivalents may be substituted without departing from the broad aspects of the invention.

We claim:

1. A railroad retarder for a railroad track having a pair of rails upon which the wheels of a railroad car travel, said railroad retarder comprising:

first and second levers joined by a fulcrum, said fulcrum being adapted for positioning below one rail of the railroad track, each lever including a brake pad, said brake pads being positioned adjacent to and on opposite sides of the one rail, said brake pads being adapted to apply braking force to the wheels of the railroad car when at least one of said levers is pivoted about said fulcrum;

an actuator having first and second plates and a flexible bladder, said plates being substantially parallel, and each plate having a central opening, said central openings being in concentric registry to form a centerline of said actuator, said bladder being secured between and to said plates to form an interior chamber, said actuator having an air inlet port to said chamber, and each plate being pivotally secured to one of said levers;

a guide mechanism including a guide rod in axially unrestricted telescoping relation with a guide sleeve, said guide rod having a mounting flange secured over said central opening of said first plate and a shaft in concentric alignment with said centerline, said guide sleeve having a mounting flange secured over said central opening of said second plate and a first tubular wall with a bore in concentric alignment with said centerline, said bore receiving a bearing for sliding engagement with said shaft of said guide rod, and said first tubular wall having an outward radial flange; and, a stop arrangement independent of said guide rod, including a stop sleeve secured to the first plate having a second tubular wall extending from said first plate, said second tubular wall surrounding and spaced radially from said guide rod and said guide sleeve, and having a free end that engages said second plate to form a lower limit stop, said second tubular wall having an inward radial flange on the free end that engages said outward radial flange of said guide sleeve to form an upper limit stop.

2. The railroad retarder of claim 1, and wherein said actuator includes a cast head that integrally forms said first plate and stop sleeve, said cast head including a pair of spaced mounts that extend outwardly from said first plate, said mounts being adapted to receive a pivot pin to pivotally join said cast head to said first lever.

3. The railroad retarder of claim 2, and wherein said guide sleeve includes a mount that extends outwardly from said second plate, said mount being adapted to receive a pivot pin to pivotally join said second plate to said second lever.

4. The railroad retarder of claim 1, and wherein said radial flanges of said guide sleeve and stop sleeve have gaps to form a cam lock connection.

5. The railroad retarder of claim 1, and further comprising a compressed air supply and controller to controllably supply compressed air via said inlet port to said interior chamber to expand said actuator and rotate at least one of said levers and brake pads toward the rail and apply a frictional force to the wheels of the railroad car.

6. A brake actuator for a railroad retarder, said brake actuator comprising:

a cast head that integrally forms a first plate and a stop sleeve, said first plate having a central opening;

a second plate having a central opening, said first and second plates being in substantially parallel relation and said central openings being in concentric registry to form a centerline of said actuator, and one of said plates having an air inlet port;

a flexible bladder secured between and to said plates to form an interior chamber of said actuator;

a guide mechanism including a guide rod in axially unrestricted telescoping relation with a guide sleeve, said guide rod having a mounting flange secured over said central opening of said first plate and a shaft in concentric alignment with said centerline, said guide sleeve having a mounting flange secured over said central opening of said second plate and a first tubular wall with a bore in concentric alignment with said centerline, said bore receiving a bearing for sliding engagement with said shaft of said guide rod, and said first tubular wall having an outward radial flange; and, a stop arrangement independent of said guide rod, including a stop sleeve secured to the first plate having a second tubular wall extending from said first plate, said second tubular wall surrounding and spaced radially from said guide rod and said guide sleeve, and having a free end that engages said second plate to form a lower limit stop, said second tubular wall having an inward radial flange on the free end that engages said outward radial flange of said guide sleeve to form an upper limit stop.

* * * * *